US007109463B2

(12) United States Patent
Milshtein et al.

(10) Patent No.: US 7,109,463 B2
(45) Date of Patent: Sep. 19, 2006

(54) AMPLIFIER CIRCUIT WITH A SWITCHING DEVICE TO PROVIDE A WIDE DYNAMIC OUTPUT RANGE

(75) Inventors: Erel Milshtein, Carmiel (IL); Ron Naftali, Shoham (IL)

(73) Assignee: Applied Materials, Inc., Santa Clara, CA (US)

( * ) Notice: Subject to any disclaimer, the term of this patent is extended or adjusted under 35 U.S.C. 154(b) by 85 days.

(21) Appl. No.: 10/208,157

(22) Filed: Jul. 29, 2002

(65) Prior Publication Data

US 2004/0016867 A1 Jan. 29, 2004

(51) Int. Cl.
*H01J 40/14* (2006.01)
*H01J 43/18* (2006.01)

(52) U.S. Cl. ..... 250/207; 313/533

(58) Field of Classification Search ..... 250/207, 250/214 VT, 214 A; 313/532, 533
See application file for complete search history.

(56) References Cited

U.S. PATENT DOCUMENTS 3,997,779 A * 12/1976 Rabl ..... 250/207
6,177,665 B1 * 1/2001 Wolf ..... 250/207
6,525,305 B1 * 2/2003 Deschamps et al. .... 250/214 R

FOREIGN PATENT DOCUMENTS

JP 09-61537 A * 3/1997

* cited by examiner

*Primary Examiner*—Thanh X. Luu
(74) *Attorney, Agent, or Firm*—Tarek N. Fahmi

(57) ABSTRACT

An amplifier circuit having an amplifier chain comprising an input port and output port with a plurality of interconnected gain stages positioned in between. The output of one interconnected gain stage provides an input to the next stage within the amplifier chain. The output port coupled to the plurality of interconnected gain stages such that the amplifier circuit output is generated from any one or more of the interconnected gain stages.

7 Claims, 5 Drawing Sheets

$I_{dN1}$
$I_{dN2}$
$I_{dNK}$
400
410
420
Amplifier with a reduction factor of 1/K
$V_{out}$ $I_{dN1}$
$I_{dN2}$
$I_{dNK}$
400
410
430
LUT processor
$V_{out}$ $I_{dN1}$
$I_{dN2}$
$I_{dNK}$
400
410
440
Current switching
$I_{dNselect}$
450
Amplifier
$I_{out}$

AMPLIFIER CIRCUIT WITH A SWITCHING DEVICE TO PROVIDE A WIDE DYNAMIC OUTPUT RANGE

FIELD OF THE INVENTION

This invention relates to methods and apparatus for amplifying signals. The invention is applicable to, but not limited to, amplification in an optical detection process for inspecting semiconductor wafers using photomultiplier tube amplifiers.

BACKGROUND OF THE INVENTION

The use of semiconductor technology has, over the last few decades, revolutionized the use of electrical and electronic goods. In particular, the increased use of semiconductor technology has resulted from a widespread, unappeasable need by business (as well as individuals) for better, smaller, faster and more reliable electronic goods.

The semiconductor manufacturers have therefore needed to make commensurate improvements in product performance, as well as in the speed, quality and reliability of the semiconductor manufacturing process. Clearly, in the mass-manufacture of semiconductors, the manufacturer needs to minimize the number of faulty semiconductors that are manufactured. Furthermore, the manufacturer clearly needs to recognize, as early as possible in the manufacturing process, when faulty semiconductors are being manufactured, so that the manufacturing process can be checked and, if appropriate, corrected.

One particular process, in the semiconductor manufacturing process cycle, which has evolved as being critical in saving time and cost in the mass manufacture of semiconductors, is the semiconductor wafer inspection process. Various semiconductor wafer inspection processes have evolved for different stages during the semiconductor wafer manufacturing process. By continuously inspecting semiconductor wafers throughout the manufacturing process, often using optical inspection techniques, flawed wafers may be removed and, if appropriate, the manufacturing process corrected at any of the various stages. This is preferable to completing the whole wafer manufacturing process, only to find that a defect exists in a final inspection or by failure during use.

Optical sensing is the process of converting optical signals (photons) into electrical signals (electrons) and subsequently measuring the optical signal. In most applications, where the optical signals are large, or the temporal frequencies are low, such conversion is performed using solid state devices known as Photodiodes. Photodiodes are inexpensive and simple to use. They have a high dynamic range, and can be very fast when the amount of light intensity is sufficiently large.

For signals where light intensity is low, photodiodes cannot operate at high speed, due to their relatively high noise level of the diode, and the small currents generated by the low light energy signals. Even though photodiodes have excellent dynamic range, their output is proportional to the optical signal, so in practice their useful dynamic range is quickly limited by subsequent electronics.

Among the more popular photosensitive devices in use today, are phototubes, used particularly in less sensitive applications such as absorption spectrometers. Phototubes consist of a single photocathode and a single anode to convert light energy into electrical energy. However, for the vast majority of photosensitive applications, phototubes do not have the internal amplification required to provide acceptable sensitivity and performance.

Hence, photomultiplier tubes (PMTS) have been developed, particularly for use when the optical signals are of low or very low light intensity and/or when the required detection frequencies are high. PMTs have a reputation of being versatile devices that provide extremely high sensitivity, low noise and an ultra-fast response.

The PMT device has therefore provided particular benefits when used for light detection over various wavelengths with minimal noise, typically limited only by the impending statistic noise (often termed 'shot noise'). As such, the PMT device is used for detecting light reflected and scattered off an investigated substance, in order to detect defects and other desired information about the substance.

In addition, PMTs may be used in various techniques, such as wafer inspection, printed circuit board (PCB) inspection, flat panel inspection, layers height and properties inspection, fluorescence spectrophotometry, Bio/Chemiluminescence's, liquid scintillation counting, high-energy physics and astronomy, photon counting and others.

A typical PMT configuration 100 is shown in FIG. 1. The PMT consists of a photoemissive cathode (photocathode) 115 followed by focusing electrodes (termed dynodes) 125 functioning as a photoelectron multiplier and a photoelectron collector (anode) 135 in a vacuum (or gas-filled) phototube 110. The photocathode 115 is capable of emitting a stream of photoelectrons when exposed to light. The dynode arrangement 125 provides for successive steps in amplification of the original photoelectron signal from the photocathode 115. The resulting signal produced at the anode 135 is directly proportional to the amount of illumination that entered the photocathode 115.

When light or a photon of light 105 of sufficient energy strikes the photocathode 115, the photocathode emits photoelectrons 120 into the vacuum due to the photoelectric effect. The photocathode material is usually a mixture of alkali metals, which make the PMT sensitive to photons throughout the visible region of the electromagnetic spectrum. The photocathode 115 is typically configured to be at a high negative voltage, typically −500 to −1500 volts.

The emitted photoelectrons 120 are then accelerated towards a series of additional electrodes (called dynodes) by a focused electric field 130 (typically configured by a supply voltage with a voltage divider resistor chain to provide a series of electrode voltages). When the photoelectrons strike each dynode 125 the photoelectrons dislodge additional photoelectrons (termed secondary photoelectrons), thus amplifying the signal by the process of secondary emission. These secondary photoelectrons then cascade towards the next dynode where they are again amplified. This cascading effect typically creates between $10^2$ and $10^7$ secondary photoelectrons for each photoelectron that is emitted from the photocathode. The amplification depends on the number of dynodes 125 and the focused electric field 130.

At the end of the dynode chain, an anode 135 at ground potential collects the multiplied secondary photoelectrons as an output signal. At this point, the output signal 140 is large enough to be easily measured using conventional electronics, such as a transimpedance amplifier, followed by an analog-to-digital converter.

Due to the secondary emission multiplication process, PMTs provide extremely high sensitivity and exceptionally low noise among the photosensitive devices currently used to detect radiant energy in the ultraviolet, visible, and near infrared regions. The PMT also features fast time response, low noise and a choice of large photosensitive areas.

The gain at each dynode 125 is a function of the energy of the incoming secondary photoelectron, which is proportional to the electrical potential between that dynode and the previous stage. The total gain of the tube is the product of the gains from all the dynodes. Typically, and as shown in FIG. 1, connecting a string of voltage-divider resistors between the cathode, all the dynodes, and ground generates the bias voltages for the dynodes. Typically, the resistance and therefore the voltage between all of the dynodes 125 and between the last dynode and anode 135 is the same. A large negative voltage 118 is then applied to the cathode, and the potential is divided up evenly across the dynodes by the voltage-divider resistor chain of the focused electric field 130.

This conventional biasing scheme is useful for operating the photomultiplier tube at a single programmable gain. Altering the applied cathode voltage changes the gain. However, the large voltages involved make it difficult to change the gain quickly, due to parasitic capacitances and the large resistor values needed to limit power dissipation in the bias string. The conventional usage is to decide on a tube gain in advance, set the appropriate cathode voltage and then operate the tube at that voltage throughout the measurement operation.

Hence, the use of known photomultiplier tubes in an optical inspection arrangement for wafers and semiconductors has a number of significant disadvantages, not least the limited dynamic range associated with the signal amplification process and fixed gain associated with the input to output signal.

Thus, there exists a need in the field of the present invention to provide an improved method and apparatus for wafer inspection, particularly a photodetection process using photomultiplier tubes, wherein the abovementioned disadvantage may be alleviated.

SUMMARY OF THE INVENTION

In accordance with a first aspect of the present invention, there is provided an amplifier having an amplifier chain comprising an input port and an output port with a plurality of interconnected gain stages therebetween. The output of one stage provides an input to the next stage within the amplifier chain and the output port is operably coupled to the plurality of interconnected gain stages such that the amplifier circuit's output is generated from any one or more of the interconnected gain stages.

In this manner, the amplifier circuit output can be adapted by selecting a preferred one or more intermediate gain stage outputs.

Preferably, the amplifier chain is contained within a photomultiplier tube where the input port is a photocathode for receiving incoming light, the output port is an anode for providing one of a number of selectable output currents and the interconnected gain stages are a plurality of interconnected dynodes arranged such that the photomultiplier tube output is generated from any one or more of the interconnected dynode stages or anode.

In such a photomultiplier tube configuration the dynamic range of the output current can be magnified whilst avoiding any impact on the circuit's shot noise. Furthermore, the output signal can be dynamically controlled and/or selected due to an inherent provision of gain selection with the choice of dynode outputs.

Further aspects of the invention are as claimed in the dependent claims.

In summary, the present invention proposes, inter-alia, to overcome the aforementioned optical detection limitations (or indeed the limitations of any multi-stage gain device) by provision of an extended dynamic range, up to several orders of magnitude. In the preferred configuration, an output signal is received from multiple dynode outputs in the PMT magnification stages (anode, $2^{nd}$ dynode, $3^{rd}$ dynode, etc.) and may be used in various ways in order to increase the device's dynamic range.

In the simplest embodiment, we consider a PMT having, for example, eight dynodes contributing to the photoelectrons' magnification, which may result in a Cathode to Anode gain range of between, say, a thousand and a million. In this case, assuming a linear distribution of divider resistance and therefore voltage between all dynodes, each dynode will multiply the current by a factor ranging from 2.68 to 7.19 (approximately, depending on the gain range). Hence, the ratio between the current flowing through the Anode and the $5^{th}$ dynode (for example) will range from 19 to 440 (again, depending on the gain used). Collecting the signals from both sources (the Anode and the $5^{th}$ dynode) will result in two outputs, which vary in current by two to three orders of magnitude. This can then be used to magnify the dynamic range of the PMT by an exact and specifically selected factor.

In more complicated constellations, the signal may be collected from each stage of the PMT (dynode 1, dynode 2 . . . Anode). It can then pass through a general mathematical manipulation, or be switched electronically from one output to another, resulting in a magnification of the device dynamic range by up to, say, five orders of magnitude.

BRIEF DESCRIPTION OF THE DRAWINGS

Exemplary embodiments of the present invention will now be described, with reference to the accompanying drawings, in which.

DESCRIPTION OF PREFERRED EMBODIMENTS

In summary, the present invention realizes optical signal detection from one or more PMT dynode outputs, in contrast to the conventional process of realizing signal detection only at the anode output.

Figure 1:
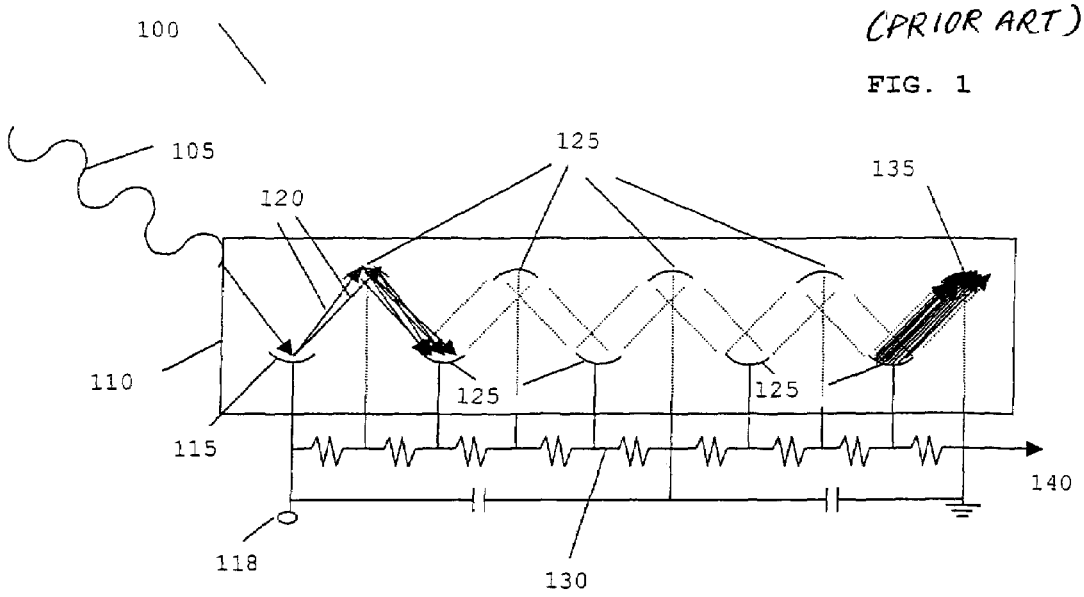
(PRIOR ART) FIG. 1
FIG. 1 illustrates a known photomultiplier tube configuration.
Figure 2:
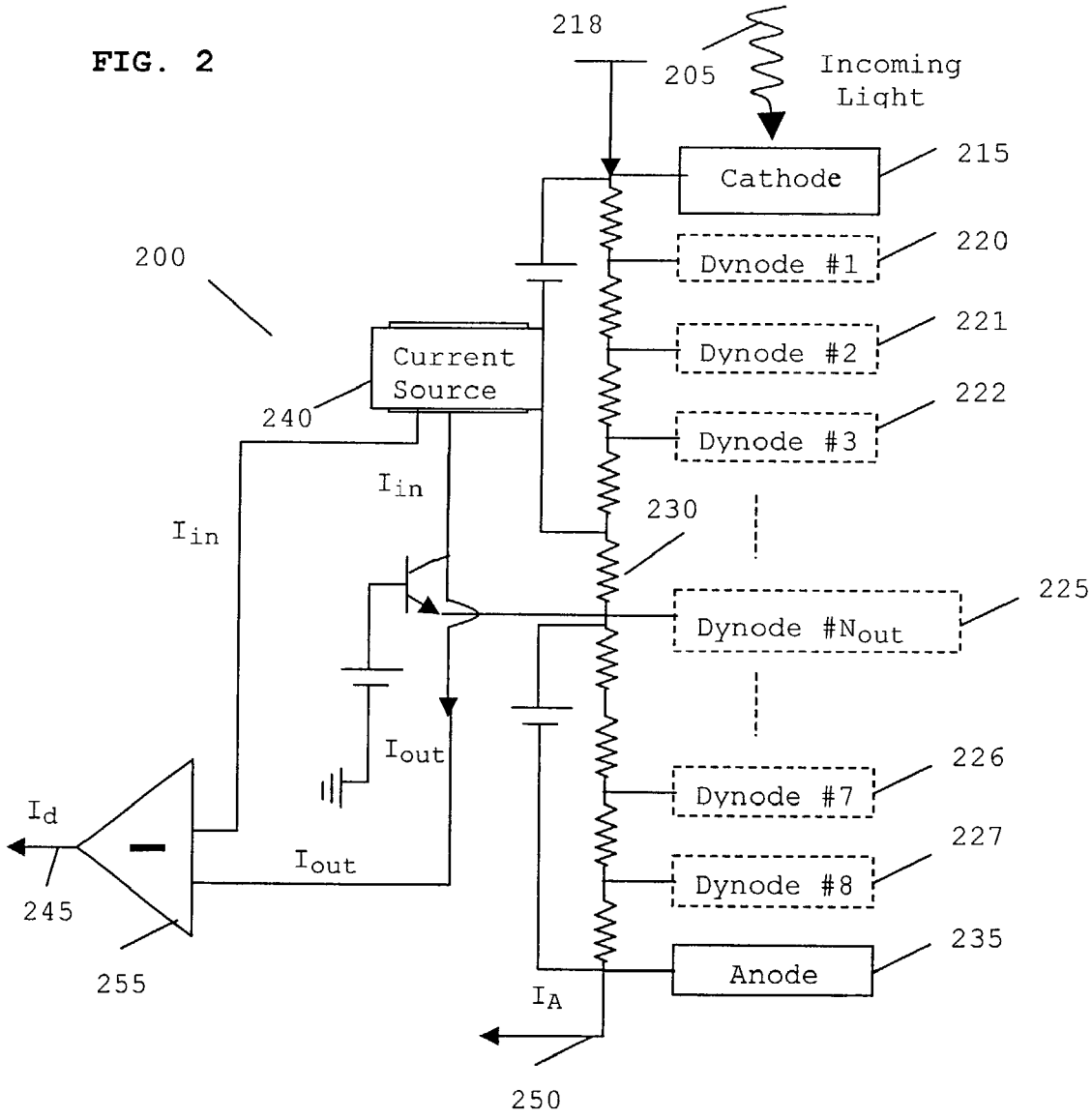
FIG. 2 illustrates a photomultiplier tube configuration in accordance with a preferred embodiment of the present invention.

Referring now to FIG. 2, incoming light 205 is directed onto a photocathode 215, which is operably coupled to an anode 235 by a series of dynodes 220–227. A large negative voltage 218 is applied to the cathode 215, and the potential is divided up across the dynodes 220–227 by the voltage-divider resistor chain 230. In accordance with the preferred embodiment of the present invention, the voltage-divider resistor chain 230 may or may not apply a linear potential drop, i.e. the resistor chain may comprise a variety of resistor values.

When light 205 of sufficient energy strikes the photocathode 215, the photocathode emits photoelectrons into the vacuum due to the photoelectric effect, in the normal manner. The emitted photoelectrons are then accelerated towards a series of dynodes by the focused electric field 230. When the photoelectrons strike a first, and then each subsequent dynode the photoelectrons dislodge additional photoelectrons (termed secondary photoelectrons), thus amplifying the signal by the process of secondary emission. After each dynode, secondary photoelectrons then cascade towards the next dynode where they create further secondary photoelectrons thereby further amplifying the signal.

The current created by the secondary photoelectrons of each dynode is exactly the current outputted by the dynode. The voltage supplied to each dynode via the focused electric field 230 does not correspond precisely to the output current. Rather they are, for example, connected by the relationship:

$$Gd=(V-Vo)\hat{}nd \quad [1]$$

Where:

V is the supplied voltage,

Vo is the output voltage,

G is the dynode gain, and the exponent nd may vary.

At the end of the dynode chain, an anode 235 may be used in the conventional manner. However, in accordance with the preferred embodiment of the present invention, a number, and preferably each, of the dynodes 220–227 is configured to be able to provide a PMT output signal. As shown, dynode $N_{out}$ 225 is configured or may be selected from a number of dynodes to provide a PMT output signal, in addition to the output signal. FIG. 2 shows only dynode $N_{out}$ 225 being selected to provide a PMT output signal, for clarity purposes only. A skilled artisan would appreciate that a similar mechanism applies to the remaining dynodes.

In an alternative embodiment of the present invention, a number of dynode outputs can be combined, or switched between, to provide the PMT output signal. In this manner, an increase in dynamic range can be achieved, whilst effectively capping the overall shot noise of the amplifier chain.

The preferred embodiment uses a constant current source $I_{in}$ 240. The deviation of the output current $I_{out}$ from this known source is measured using the relationship:

$$I_d=I_{in}-I_{out} \quad [2]$$

Where:

Id=the current 245 from dynode $N_{out}$ obtained from subtracting the deviation of the output current $I_{out}$ from the constant current $I_{in}$ in subtractor 255.

It is within the contemplation of the invention that a variety of circuit designs could be configured to utilise the inventive concepts of the present invention, and that the hereinafter described configurations represent the preferred embodiments only. For example, the preferred embodiment is described with respect to using eight dynodes, and a skilled artisan would readily appreciate that any number of dynodes could be used between the photocathode and anode and selected as the preferred PMT output. Preferably, the total number of dynodes to be used in the PMT arrangement is selected to maintain the desired bandwidth for low Cathode to Anode gain.

As mentioned above, it is within the contemplation of the invention that alternative resistor/voltage distributions may be used. For example, particular groups of dynode outputs may be configured to address particular output current ranges, say, by use of appropriate selection of associated resistor values. Therefore, it is clearly envisaged that a variety of configurations would be considered to be encapsulated within the spirit and scope of the present invention.

In order to appreciate better the benefits of selecting one or more particular dynode outputs, let us consider the mathematical implications. First, let us assume a typical case in which burst of photons/light 205 of low intensity are directed onto the photocathode 215 at levels varying from, say, 1 μW to 0.1 nW. Let us assume that the bursts occur in very small periods ranging down to tens of nanoseconds.

The following parameters are also defined:

N—Number of dynodes in the PMT.

R—Photo-cathode sensitivity in μA/μW.

$I_{SAT}$—Anode saturation current.

$I_A$(250)—Anode output current.

$I_d$—Current at dynode d.

$G_{min}$—Minimal gain possible between Cathode to Anode.

$G_{max}$—Maximal gain possible between Cathode to Anode.

$G_A$—Gain from Cathode to Anode.

$G_d$—Gain from the Cathode to dynode d.

$N_{out}$—Number of the dynode from which the output signal is collected.

Let us assume that a light pulse varies by four orders of magnitude, as described above, and configure the device characteristics such that an output signal may fall to, say, $0.1*I_{SAT}$. A value of $0.1*I_{SAT}$ is selected to avoid the electronic amplifier noise exceeding the noise exhibited by the light signal intensity (shot-noise). In this manner, the signal measurement will not be shot-noise-limited.

Advantageously, the inventor of the present invention has shown below that by switching between different PMT outputs (anode 235 or any of the dynodes 220–227), the system will remain shot noise limited simultaneously for either high or low level input signals.

At low light level, the desired Cathode-to-Anode gain may be calculated as follows. In order to achieve an electrical signal that will be at a desirable level of $0.1*I_{SAT}$ at the Anode, assuming a typical low light level of 0.1 nW, we find:

$$G_A=0.1*I_{SAT}/(0.1\ \text{nW}*R) \quad [3]$$

We see that for typical PMT parameters of R=0.06, and $I_{SAT}$=100 uA, $G_A$=1.07e6, which is well within the achievable gain range of 1e3–1e7.

We now proceed to determine the preferred dynode number $N_{out}$, to be used for the collection of the high light level signal. It can be easily seen that:

$$N_{out}=\text{floor}[(1+N)*(\text{Log } G_A-4)/(\text{Log } G_A)] \quad [4]$$

Where the term 'floor' indicates a truncation of a real number to its closest (lower) integer number, for example floor (5.743)=5 or floor (−6.54)=−7.

Note that in the above formulae, we considered the gain of a single dynode stage to be less than '10', which is representative of practical values.

In the above, the current collected at dynode $N_{out}$ for the high light level ($I_{Nout}$) will therefore be:

$$I_d=1e-6*R*G_A\hat{}(N_{out}/N) \quad [5]$$

This current will always be maintained at between $0.1*I_{SAT}$ to $I_{SAT}$, which means it can be amplified, in a similar manner to $I_A$, without increasing the noise beyond the shot noise level. Hence, by switching between different PMT outputs (anode 235, or any of the dynodes 220–227), the individual shot noise limits on the dynode currents $I_d$ ensure that the overall signal remains shot-noise-limited for either high or low light intensity signals.

In general, one may implement the solution of FIG. 2 using the outputs from several dynodes and/or Anode, resulting in a selection of several output currents $I_{dN1}$, $I_{dN2}$, . . . , $I_{dNK}$ and $I_A$, where K is the number of outputs from the dynodes (K=8 in FIG. 2). A combination of these output currents results in a magnified dynamic range. This is due to the fact that the output signal is actually 'duplicated' in each dynode output where, at each stage, an additional multiplication factor is imposed on it.

It is known that a typical amplifier may amplify signals, whilst remaining shot-noise-limited, when the input currents are between $0.05*I_{sat}$ to $I_{sat}$. Any signal that is outside of these limits may not be amplified properly. For this reason, the PMT's original dynamic range is of an order of 1 to 20. However, by incorporating the inventive concepts herein described, multiplied clones of the measured signal may place signals having a dynamic range of the order of 1 to 200000, within the amplifier dynamic range of 1 to 20 (by multiplying, say, the $200000^{th}$ signal by 0.0001, the $20000^{th}$ signal by 0.001, and so on). This action will enable the amplifier to amplify signals with the magnified dynamic range. Clearly, a skilled artisan would recognise that the actual implementation of the dynamic range magnification may take several forms. A preferred simple form is to clip each one of the currents to a maximally set current and add the resulting clipped current of all of the dynode outputs. In particular, if the highest currents are clipped, an extended dynamic range of the form shown in equation [6] below is achieved. In this manner, the output current will not increase linearly as IA increases, but it will result in a semi-logarithmic amplification of the signal, as shown in FIG. 3.

Figure 3:
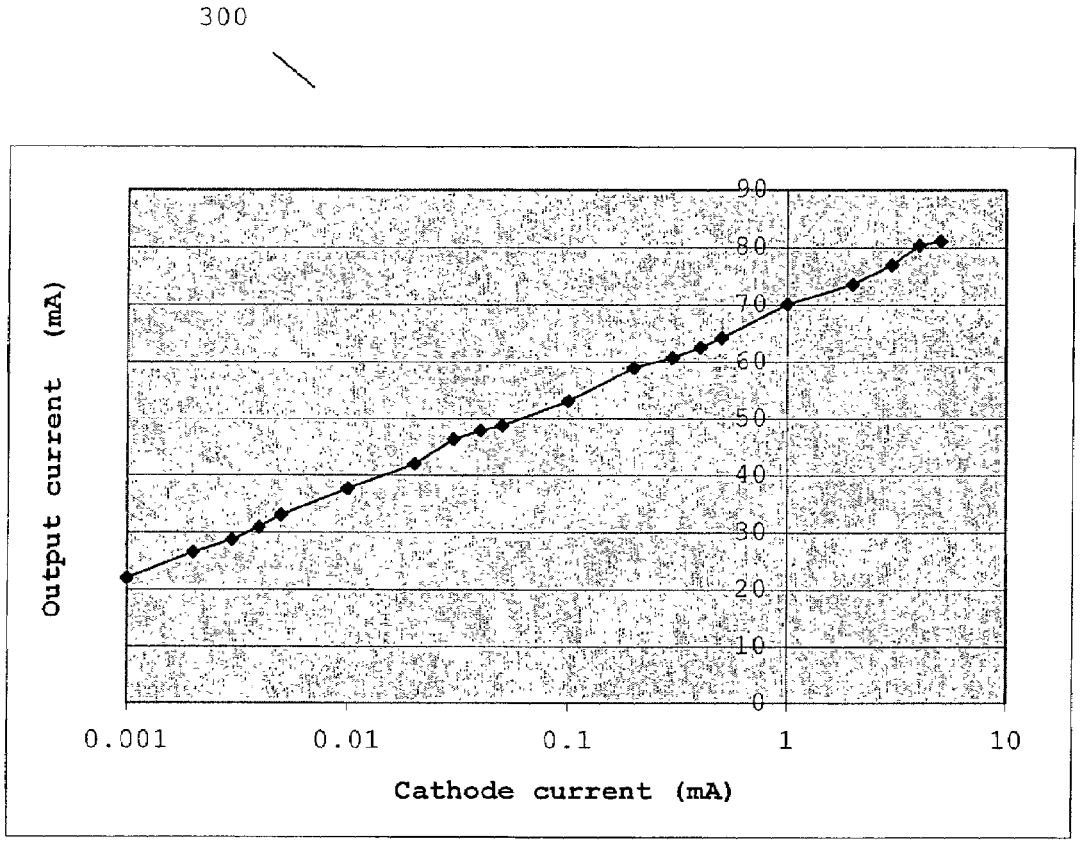
FIG. 3 shows a graph of cathode current versus output current for a photomultiplier tube configuration adapted in accordance with the preferred embodiment of the present invention.

Referring now to FIG. 3, a graph 300 illustrates various photocathode current levels (in milliamperes (mA)) versus the output current resulting from such a 'clipped sum' operation, as performed on the total current from the combination of each of the dynodes. As can be seen, the result of the preferred clipping method would be a semi-logarithmic amplification of the Cathode current, where the cathode current varies over four orders of magnitude whilst maintaining an output current substantially between 20 to 80 μA. In this manner, the clipping function basically reduces any current that is higher then $I_{sat}$ to $I_{sat}$.

In summary, the maximum anode current can be set at say, 100 μA, and various combinations of dynode output currents configured to 'clip' at this maximum level, for example the $2^{nd}$ 221, $3^{rd}$ 222 and $5^{th}$ dynode outputs. Accessing current output information from a memory device such as a look-up table can perform the particular selection of dynode outputs. By clipping a combination of a number of dynode outputs at this maximum current level, a larger dynamic range of output signals is achieved. Beneficially, the overall shot noise due to the respective dynode outputs is capped.

Figures 4A, 4B, 4C:
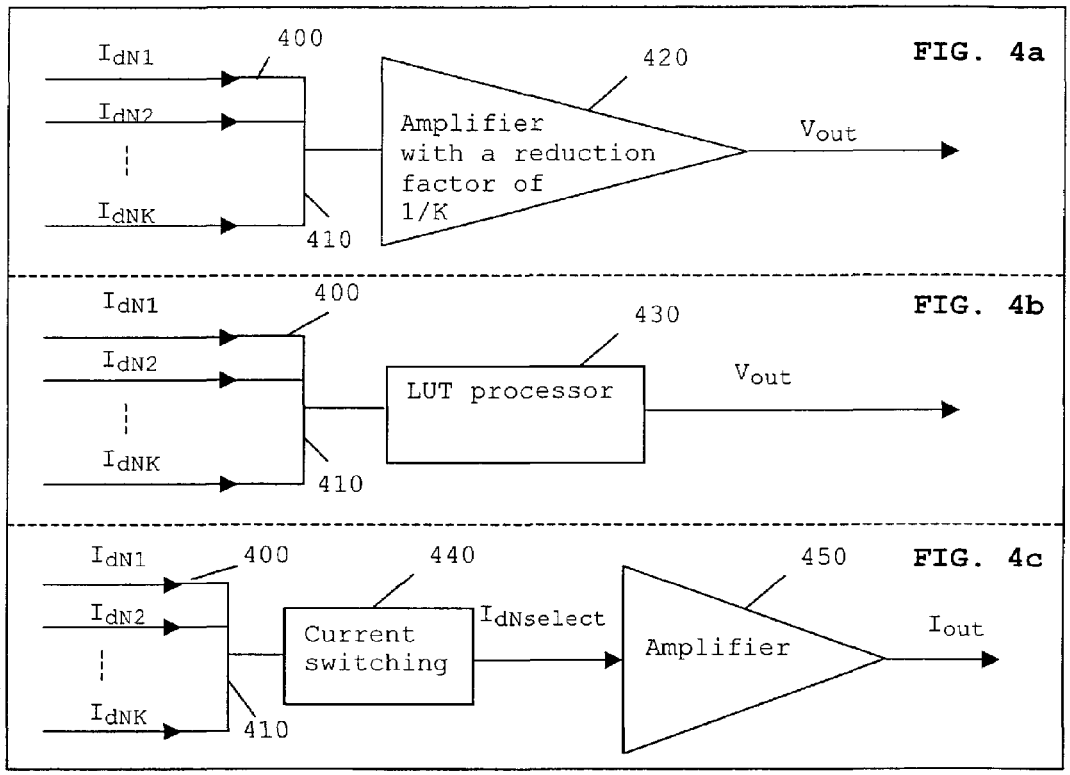
FIGS. 4*a*–4*c* show different configurations for obtaining an output current from a number of dynodes of a photomultiplier tube configuration adapted in accordance with the preferred embodiment of the present invention.

Referring now to FIGS. 4*a* to 4*c*, a variety of circuit configurations are illustrated that employ the inventive concepts herein described. FIG. 4*a* shows a circuit configuration that employs the above concept of clipping. A series of dynode current outputs $I_{dN1}$ to $I_{dNk}$ 400–410 are fed into an amplifier 420 that has a reduction factor of 1/k. In this manner, the output $V_{out}$ is generated from a clipped dynode current. The clipping operation provides advantages in at least two respects. First, it addresses a problem with the amplifier 420 having a limited input current in which it may amplify properly. Secondly, in order to sum the current of different dynodes the current value of the dynodes closer to the Anode must be clipped. Otherwise, the result will be a multiplied signal of the form:

$$I_A+K*I_A+K*K*I_A+\ldots K\hat{}N*I_A=I_A*\text{Const.} \quad [6]$$

If the highest currents are clipped, the resulting output provides an extended dynamic range of the form:

$$I_{sat}+I_{sat}+K*K*I_A+\ldots K\hat{}N*I_A \quad [7]$$

In this manner, the output current will not increase linearly as $I_A$ increases, but it will result in a semi-logarithmic amplification, as shown in FIG. 3.

FIG. 4*b* illustrates an alternative method where one or more of these output currents 400–410 are selected by accessing a look-up table (LUT) 430. The LUT 430 approach is able to change the significance of each of the dynode output currents according to a pre-defined or dynamically adjusted value, in contrast to performing a simple averaging technique.

In this alternative embodiment of the present invention, groups of dynode outputs may be configured to provide output current levels within a particular range, for example range 1 provided by dynodes 1–3, range 2 provided by dynodes 4–6 and range 3 provided by dynodes 7–8. In such a configuration, it is envisaged that the LUT processor/controller 430 selecting appropriate outputs, will use the particular dynode or group of dynodes in a rough tuning operation, to find the closest output current to the optimal. It is then envisaged that a corresponding adjustment of the supplied power applied to the selected dynode or group of dynodes can be used to fine-tune the output current to the optimal level. In this manner, much more accurate output currents can be obtained.

Since $G_A$ may be pre-defined by the particular circuit configuration and parameters used, based on the 'roughly expected' minimal light levels to be amplified, the most appropriate dynode output(s)/value(s) of $N_{out}$ can be determined. Thus, in a yet further alternative embodiment of the present invention, the amplifier circuit can then be programmed to switch between these two current outputs (the Anode and dynode number $N_{out}$), using current switching function 440 as shown in FIG. 4*c*. The current switching function 440 will choose between the designated measured currents according to their values. Such switching can be activated in a bandwidth that is higher than the original PMT bandwidth. The selected currents are then amplified in amplifier 450 to provide an appropriately amplified output current. A skilled artisan would appreciate that many known current switching circuits and configurations could be used to effect the current switching described above.

Figure 5:
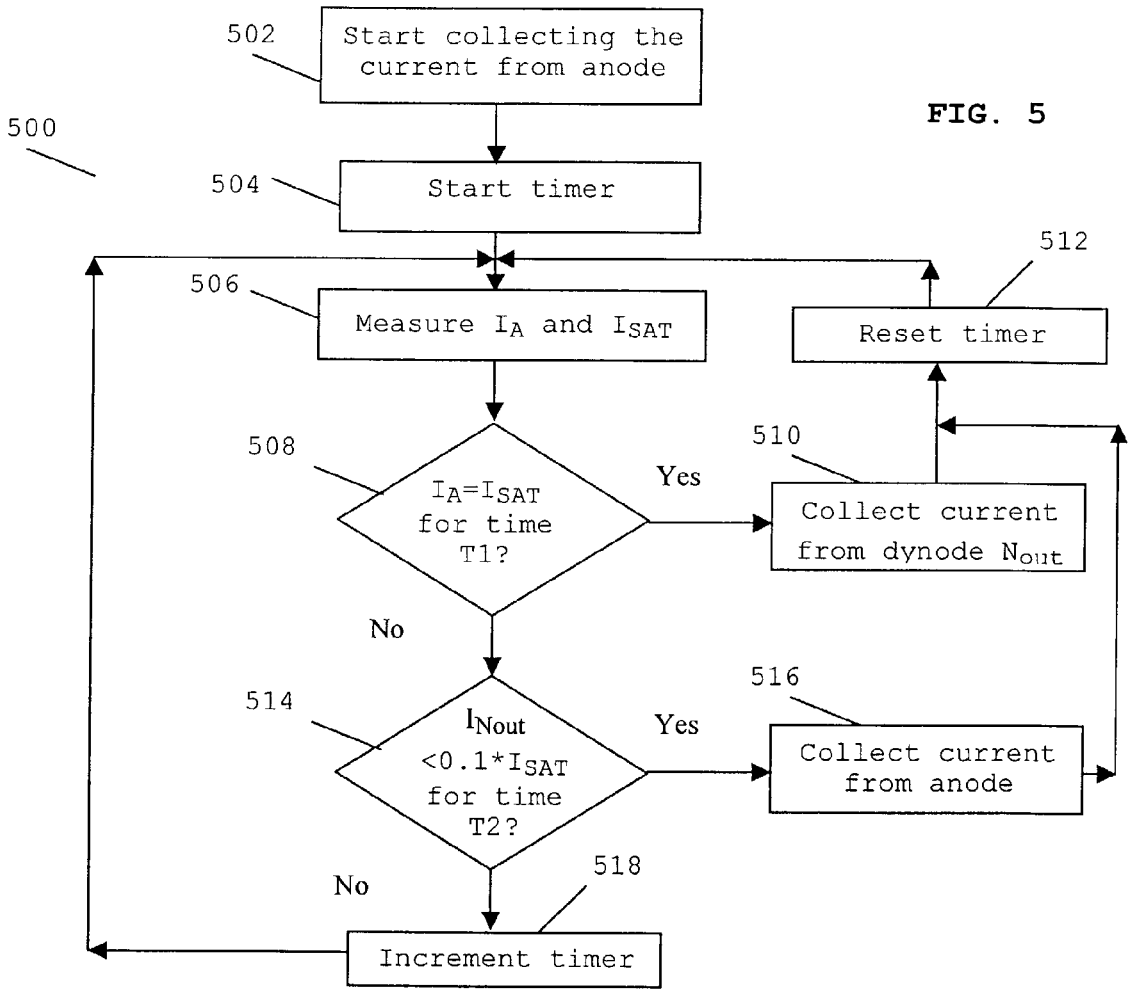
FIG. 5 shows a flowchart illustrating the method of selecting an output current in accordance with the preferred embodiment of the present invention.

The switching operation of the preferred embodiment of the present invention is described in greater detail in relation to the flowchart of FIG. 5. Referring now to FIG. 5, a flowchart 500 illustrates the dynode/anode output current switching operation according to a preferred embodiment of the present invention. Initially, the anode current is collected as the PMT output current, as shown in step 502. A timer is initiated, as in step 504, and a measurement is taken of $I_A$, with $I_{SAT}$ being a predefined characteristic of the device and therefore known, as shown in step 506. The use of a timer mechanism creates a hysteresis process in the measurement step, which ensures that there will be no flipping back and forth between dynode outputs at a high rate.

If $I_A$ equals $I_{SAT}$ for a pre-determined time T1, as shown in step 508, the output current is switched to being collected from dynode number $N_{out}$, as in step 510. Once the T1 timer has been reached, the timer is reset in step 512, and the measurement process Of $I_A$ and $I_{SAT}$ in step 506 repeated. The use of two timer periods is beneficial in order to disable rapid switching fast transitions between the different dynode outputs or anode, which may result in additional noise or, in a worst case, an overall malfunction of the device.

If $I_A$ does not equal $I_{SAT}$ for a pre-determined time T1, in step 508, then a determination is made as to whether $I_{Nout}$ is less then $0.1*I_{SAT}$ for a pre-determined time T2, as shown in step 514. If $I_{Nout}$ is less then $0.1*I_{SAT}$ for a pre-determined time T2, then the output current is switched to the anode output, as in step 516. Once the T2 timer has been reached, the timer is again reset in step 512, and the measurement process of $I_A$ and $I_{SAT}$ in step 506 repeated. If $I_{Nout}$ is not less then $0.1*I_{SAT}$ for a pre-determined time T2, in step 514, then the timer is incremented, and the measurement process of $I_A$ and $I_{SAT}$ in step 506 repeated.

In the preferred embodiment of the present invention, T1 and T2 are set in the region of 10 to 100 nsec. However, in alternative configurations it is envisaged that other time periods may be used for T1 and/or T2. In this manner, the current is switched between the appropriate dynode output currents dependent upon the time period that the anode output current is in a saturated state.

It is envisaged that the aforementioned inventive concepts, for example with regard to the selection of, or switching between, any number of intermediate stage outputs to provide an overall output can be applied to any multi-stage gain device or arrangement. In such a context, the preferred embodiment of a PMT-based configuration is illustrated as only an example, where the benefits of increased dynamic range, whilst maintaining an overall shot noise limited performance, offer particular advantages.

Furthermore, the preferred application in a PMT-based configuration is in the inspection of wafers and interconnects using a scattering light process, where the optical detection mechanism using the PMT arrangement described above requires accurate and speedy measurement of very low current levels in small periods of time.

It is envisaged that a processor runs an algorithm to select one or more of the dynode or anode outputs. The algorithm may be pre-determined or dynamically updated. Furthermore, the power supply levels may be pre-determined or adjusted for a particular application or semi-conductor wafer or inspection process. Alternatively, the fine-tuning of current levels or the algorithm itself may be re-programmed into the processor to adapt the PMT's performance.

As such, it is envisaged that the algorithm and any power (current) supply or threshold level may be controlled by processor-implementable instructions and/or data, for carrying out the methods and processes described, which are stored in a storage medium or memory element. The storage medium may be a circuit component or module, for example a random access memory (RAM) or programmable read only memory (PROM), or a removable storage medium such as a disk, or any other suitable medium.

The various components within the inspection tool are realised in this embodiment in an integrated component form. Of course, in other embodiments, they may be realized in discrete form, or a mixture of integrated components and discrete components, or indeed any other suitable form.

Furthermore, it is within the contemplation of the invention that the circuit configuration to implement the inspection algorithm and/or any associated threshold or power supply levels as described in the above embodiments can be embodied in any suitable form of software, firmware or hardware.

It will be understood that the PMT configuration described above provides at least the following advantages:

(i) The switching mechanism described in FIG. 4*c* and FIG. 5 does not affect the PMT bandwidth.

(ii) Using a selection of the most appropriate dynode output or a combination of a number of selected dynodes outputs improves the accuracy and increases the dynamic range of the PMT arrangement, whilst limiting any impact on the shot noise level.

(iii) By dividing the power supply to the dynodes according to the outputs selection, as seen in FIG. 2. The voltage supplied to each set of dynodes, and hence the gain achieved by them, may be more variably set according to the inspected signals.

(iv) The dynamic selection of output signal offers a more controllable gain in the amplifier chain when compared with prior art fixed output (and therefore gain) arrangements.

Whilst the specific and preferred implementations of the embodiments of the present invention are described above, it is clear that one skilled in the art could readily apply variations and modifications of such inventive concepts that would fall within the spirit and scope of the present invention.

Thus, an improved amplifier circuit with an enhanced dynamic range and method for wafer inspection, particularly used in a photodetection process, has been described wherein the aforementioned disadvantages associated with prior art arrangements have been substantially alleviated.

We claim:

1. An amplifier circuit having a photomultiplier tube comprising a photocathode; an anode; a plurality of dynodes interconnected with one another and between the photocathode and the anode so that an output of one dynode provides an input to a next dynode within the photomultiplier tube; and a switching device having a first terminal coupled to an output of a constant current source and a second terminal operable to be selectively coupled to a respective output of any of the dynodes coupled between the photocathode and the anode such that an amplifier circuit output current representing a difference between an output of the constant current source and an output of a selected one of the dynodes is generated by the switching device switching the output between any one or more of the dynodes and the switching device switches between a respective dynode output current dependent upon a time period that an output current from the anode is in a saturated state.

2. The amplifier circuit according to claim 1, wherein said amplifier circuit further comprises a series of voltage dividers operably coupled to respective dynodes so as to provide a variety of dynode currents.

3. The amplifier circuit according to claim 1, wherein said amplifier circuit further comprises a current clipping mechanism, operably coupled to the plurality of interconnected dynodes and arranged to clip the output of each of the interconnected dynodes to a respective maximum output current.

4. The amplifier circuit according to claim 3, wherein said amplifier circuit further comprises a combiner operably coupled to the current clipping mechanism to sum a number of clipped currents from a number of interconnected dynodes.

5. The amplifier circuit according to claim 1, wherein said amplifier circuit further comprises an amplifier operably configured to receive inputs from sub-groups of said plurality of said dynodes, and amplifying a dynode current output from a sub-group to provide a rough tuning operation of the amplifier circuit output.

6. The amplifier circuit according to claim 5, wherein said amplifier includes a reduction factor to clip the current output from the respective group of dynodes.

7. The amplifier circuit according to claim 1, the amplifier circuit further comprising a memory device operably coupled to the plurality of interconnected dynodes for selecting one or more gain stages to provide the output current for the amplifier circuit.

* * * * *